US009446578B2

(12) United States Patent
Van Ostrand et al.

(10) Patent No.: US 9,446,578 B2
(45) Date of Patent: Sep. 20, 2016

(54) METHODS OF MANUFACTURE AND USE OF CUSTOMIZED FLEXOMASTER PATTERNS FOR FLEXOGRAPHIC PRINTING

(71) Applicant: Eastman Kodak Company, Rochester, NY (US)

(72) Inventors: Dan Van Ostrand, The Woodlands, TX (US); Kevin Derichs, The Woodlands, TX (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 14/404,892

(22) PCT Filed: Jun. 11, 2013

(86) PCT No.: PCT/US2013/045146
§ 371 (c)(1),
(2) Date: Dec. 1, 2014

(87) PCT Pub. No.: WO2013/188379
PCT Pub. Date: Dec. 19, 2013

(65) Prior Publication Data

US 2015/0122138 A1 May 7, 2015

Related U.S. Application Data

(60) Provisional application No. 61/657,942, filed on Jun. 11, 2012.

(51) Int. Cl.
*B41F 5/24* (2006.01)
*B41M 1/04* (2006.01)

(52) U.S. Cl.
CPC . *B41F 5/24* (2013.01); *B41M 1/04* (2013.01)

(58) Field of Classification Search
CPC ..... B41F 5/00; B41F 5/02; B41F 5/24
See application file for complete search history.

(56) References Cited

U.S. PATENT DOCUMENTS 4,101,324 A * 7/1978 Mizuno ..... G03F 7/2022 430/262
4,610,950 A * 9/1986 Milliken ..... G03F 7/2022 430/306

(Continued)

FOREIGN PATENT DOCUMENTS

JP 2009-059762 A 3/2009
JP 2011-115973 A 6/2011

(Continued)

OTHER PUBLICATIONS

PCT/US2013/045146 International Search Report and Written Opinion dated Sep. 27, 2013 (9 pgs.).

*Primary Examiner* — David Banh
(74) *Attorney, Agent, or Firm* — Kevin E. Spaulding

(57) ABSTRACT

A method of flexographically printing a uniform pattern on a substrate where the ink deposited on the substrate is deposited in the intended location and not in unintended locations. A flexo-master comprises a pattern formed by a plurality of lines including at least one junction, and printing the pattern including the at least one junction in ink on a substrate forming a printed pattern, wherein the printed junction has a different shape than the at least one junction on the flexo-master. In addition to the junction formation, a discontinuous line on the flexo-master may be used to print a continuous line, a single line may be used to print two lines, and two or more lines may be used to print a single line. The flexo-master pattern lines may additionally have a fill pattern comprising various geometries that are used to uniformly print the pattern on the substrate.

6 Claims, 15 Drawing Sheets

(56) References Cited

U.S. PATENT DOCUMENTS 6,314,879 B1 11/2001 Siler et al.
6,343,550 B1 2/2002 Feesler
6,701,847 B2 * 3/2004 Weichmann ..... B41C 1/05 101/492
6,984,478 B2 * 1/2006 Dreher ..... B41C 1/00 430/30
7,126,724 B2 * 10/2006 McCrea ..... B41C 1/00 101/395
9,056,450 B2 * 6/2015 Kennair ..... B41F 5/24
2002/0152911 A1 * 10/2002 Weichmann ..... B41C 1/05 101/492
2002/0170451 A1 11/2002 Nakazawa et al.
2003/0113466 A1 6/2003 Frazzitta et al.
2005/0157347 A1 * 7/2005 Dewitte ..... H04N 1/4058 358/3.3
2007/0181016 A1 8/2007 Schaede
2007/0190452 A1 * 8/2007 Kimelblat ..... B41N 1/12 430/270.1
2008/0199660 A1 * 8/2008 Gelli ..... B31F 1/07 428/172
2009/0191333 A1 7/2009 Pinto et al.
2010/0028815 A1 2/2010 Zwadlo
2010/0314058 A1 * 12/2010 Hupp ..... D21H 27/002 162/109
2011/0180826 A1 7/2011 Morito et al.
2011/0259221 A1 10/2011 Hargreaves et al.
2012/0048135 A1 * 3/2012 Burberry ..... B41C 1/05 101/483
2012/0196229 A1 * 8/2012 Sanger ..... B41M 1/00 430/306
2014/0053746 A1 * 2/2014 Ramakrishnan ..... B41F 5/24 101/375
2014/0245908 A1 * 9/2014 Ramakrishnan ..... B41F 5/24 101/23
2014/0245912 A1 * 9/2014 Ramakrishnan ..... B41F 5/24 101/142
2014/0290517 A1 * 10/2014 Miller ..... B41F 27/005 101/481
2015/0030984 A1 * 1/2015 Ramakrishnan ..... G03F 7/2022 430/306

FOREIGN PATENT DOCUMENTS

WO 2006092817 A1 9/2006
WO 2013188379 A1 12/2013

* cited by examiner

METHODS OF MANUFACTURE AND USE OF CUSTOMIZED FLEXOMASTER PATTERNS FOR FLEXOGRAPHIC PRINTING

CROSS-REFERENCE TO RELATED APPLICATIONS

This application is a national stage of and claims priority under 35 U.S.C. §371 to International Patent Application Serial No. PCT/US2013/045146, filed on Jun. 11, 2013, entitled "METHODS OF MANUFACTURE AND USE OF CUSTOMIZED FLEXOMASTER PATTERNS FOR FLEXOGRAPHIC PRINTING," by Dan VAN OSTRAND, et al., which claims the benefit of and priority under 35 U.S.C. §119 to U.S. Provisional Pat. App. No. 61/657,942, filed Jun. 11, 2012, entitled "Method for Producing Precision Flexographic Printed Patterns," by Dan VAN OSTRAND, et al., which are both incorporated by reference herein in their entirety for all purposes.

FIELD OF THE DISCLOSURE

This disclosure relates, but is not limited to the methods for printing conducting patterns on flexible substrates; more specifically, the disclosure relates to a method for producing high-precision (sub-50 μm) flexographic masters for printing patterns.

BACKGROUND

Flexography is a form of rotary web letterpress, combining features of both letterpress and rotogravure printing, using relief plates comprised of flexible rubber or photopolymer plates and fast drying, low viscosity solvent, water-based or UV curable inks fed from an anilox roller. Traditionally, flexo-master patterns are created by bitmap pattern, where one pixel in bitmap image correlates to a dot of the flexo-master. For instance, pixels arranged in a straight line in the bitmap image will turn into a continuous straight line on the flexo-master. For traditional printing of graphic images, the width of lines or features printed may be important as long as the printed image looks good to the human eye. For flexographic printing or flexo-printing, a flexible plate with relief image is usually wrapped around a cylinder and its relief image is inked up and the ink is transferred to a suitable printable medium. In order to accommodate various types of printing media, flexographic plates may have a rubbery or elastomeric nature whose precise properties may be adjusted for each particular printable medium. In general, the flexographic printing plate may be prepared by exposing the UV sensitive polymer layer through a photomask, or other preparation techniques.

BRIEF SUMMARY

In an embodiment, a method of flexographically printing a substrate comprising: disposing a flexo-master on a roll, wherein the flexo-master comprises a pattern formed by a plurality of lines including at least one junction, printing the pattern including the at least one junction in ink on a substrate forming a printed pattern, wherein the printed junction has a different shape than the at least one junction on the flexo-master.

In an embodiment, a system for flexographically printing a substrate comprising: a printing plate cylinder, wherein an anilox roll transfers ink to a flexo-master disposed on the printing plate cylinder, wherein the flexo-master comprises a pattern comprising a plurality of lines, and wherein at least one of the lines of the plurality of lines is a discontinuous line; and a substrate, wherein the flexo-master prints the pattern on the substrate using the ink, and wherein the at least one discontinuous line prints a continuous line on the substrate.

In an alternate embodiment, a system for flexographically printing a microscopic pattern using a plurality of flexo-masters comprising: a plurality of printing plate cylinders and a plurality of flexo-masters, a substrate; wherein at least some of the plurality of printing plate cylinders are used to print a single pattern using at least one ink type from at least one ink source; wherein each flexo-master of the plurality of flexo-masters is disposed on each of the at least some of the plurality of printing plate cylinders and comprises at least a portion of the single pattern, wherein each portion of the single pattern comprises a plurality of lines; wherein at least one flexo-master of the plurality of flexo-masters comprises a pattern formed by a plurality of lines including at least one junction, and wherein at least one of the lines of the plurality of lines is a discontinuous line; and wherein the at least one flexo-master prints the pattern on the substrate using the ink, wherein the printed junction has a different shape than the at least one junction on the flexo-master, and wherein the at least one discontinuous line prints a continuous line on the substrate.

DETAILED DESCRIPTION

Figure 1:
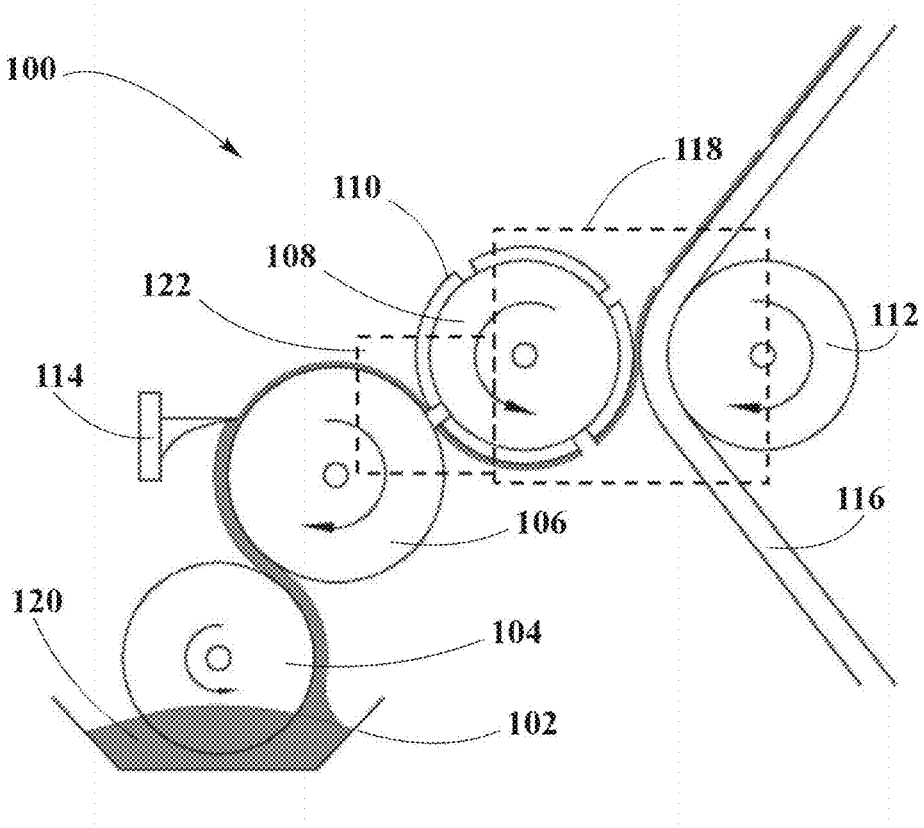
FIG. 1 illustrates an exemplary flexo-printing process that may be capable of implementing embodiments of the present disclosure.

The present disclosure a method of printing high-precision, continuous lines and patterns on a substrate using non-continuous patterns on the flexo-master. The term "flexo-master," as used herein, may refer to the rubber or photopolymer piece or sheet comprising the patterns to be printed on to a substrate. Generally, the flexo-master is the "master-copy" or master-plate, having a relief or relieved shape. In alternative embodiments, the flexo-master may comprise a raised shape of a pattern for printing on a substrate.

The patterns are formed on the flexo-master by engraving a pattern modified account for or in consideration of the physical characteristics of the flexo-master material and the effects that the different printing factors such as target speed, viscosity, pressure and volume of ink that anilox roll have on the final printed pattern. As used herein the term "anilox roll" refer to a cylinder used to provide a measured amount of ink to a printing plate. In an embodiment, to form a flexo-master, a pattern designed using any CAD software is converted into a tagged image format file (tiff file). Then it is loaded to a laser imaging system. In the laser imaging system the pattern is ablated into the black resist material covering a UV transparent substrate. Next, a blank elastomeric laminated photoresist (also known as a "flexo-plate" or a "flexo-blank") is exposed to a UV light through the laser ablated pattern. Where the UV light interacts with the flexo-plate, said pattern is "recorded" in the laminated photoresist. Once the UV exposure is complete, the flexo-plate is developed, dried and cut. This may then be referred to as a flexo-master (laminated elastomeric photoresist, carrying the pattern on one side) and may then be then adhered to printing plate cylinder. It is appreciated that the terms "flexo-plate" and "flexo-master" may be used interchangeably herein to mean a patterned flexo-blank capable of printing a pattern or a portion of a pattern. Please note that this is one method for making a flexo-master, but not the only method. Other methods include direct laser ablation of the pattern into a polymer substrate. Either of these patterning methods can be done on flat plates or on patternable material pre-coated on a cylinder sleeve. Patterned sleeves can be mounted to the printing plate cylinder by simply sliding them over the end of the cylinder. This disclosure is not dependent upon a specific method for making a flexo-master, but rather is focused on methods for overcoming the drawbacks inherent in the physical properties of the flexo-material, ink, substrate, and printing equipment. The ink as discussed herein may refer to the combination of monomers, oligomers, or polymers, metal elements, metal element complexes or organometallics in a liquid state that is discretely applied over a substrate surface.

For instance, wide solid lines may be formed by making a pattern on the flexo-master comprising multiple thin lines or features. In certain instances, a flexo-master configured thusly may avoid printing defects, such as non-uniform ink transfer within large features, for example greater than about 50 μm, and potential continuity problem at the boundary between large and small features or lines. Non-uniform ink transfer is the term used to describe when ink is deposited in an unintended manner, forming an unintended pattern or portion of a pattern as opposed to uniform ink transfer where ink is deposited in the shape of an intended pattern. As used herein, the term "uniform" is meant to distinguish intentional ink deposition on a substrate as opposed to unintentional ink deposition on the substrate. The term "repeatable" is used herein to refer to the ability of a flexo-master as well as the systems and methods employing the flexo-master (or flexo-masters) to print uniform patterns on a reliable, consistent basis. Another aspect of the present disclosure provides a technique to print lines or features in different angles, as well as a accommodating the changes to line or feature patterns caused by the swelling of the flexo-master in time and with continued operation. Furthermore, throughout this disclosure and description of the reference to lines should be interpreted to include any pattern that can be made from a CAD drawing.

The disclosures of WO/2006/092817, entitled "Embossing Roller, Embossing Device Including Said Roller And Paper Article Produced With Said Embossing Device", US20070181016, entitled, "Printing Machine," US20020170451, entitled "Method Of Lithographic Printing," US20070190452, entitled, "Flexographic Printing Plate Precursor And Imaging Method," US20100028815, entitled "System And Method Employing Secondary Back Exposure Of Flexographic Plate," and US20090191333 entitled, "Method For Providing Or Correcting A Flexographic Printing Plate, Sleeve, Or Precursor Thereof" may be relevant to the disclosure herein, and are hereby incorporated by reference.

Flexography is a form of a rotary web letterpress where relief plates are mounted on to a printing cylinder, for example, with double-sided adhesive. However, traditional flexo-printers cannot consistently print fine lines with widths of less than 10 microns (μm) that are unbroken and of uniform width. The flexo-printing process has certain commercially favorable characteristics such as ease of use and cost. However, for printing high precision patterns commercially, the method and process may not consistently control printed feature width, thickness and pattern continuity due to convention weaknesses. In some examples, the flexo-substrate may be too flexible, therefore, fine line patterns are easily distorted making it difficult to maintain the shape and continuity of the fine printed lines and patterns. In addition, the flexo-substrate is absorbent to humidity and fluids and may swells. Swelling of the flexo-substrate may lead to differential distortion of different sized features, especially when these distortions are in close proximity. Additionally, different volumes of ink are printed depending on the pattern and proximity of various features. Thus wide line patterns, having greater than about 50 μm individual line or feature width, do not print a uniform layer of ink within the full width of the pattern. As such, there is a need in the industry to flexo-graphically print high-precision patterns.

These relief plates, which may also be referred to as a master plate or a flexoplate, may be used in conjunction with fast drying, low viscosity solvent, and ink fed from anilox or other two roller inking system. It is appreciated that a master plate may be any roll carrying a predefined pattern used to print on any substrate and that the anilox roll may be a cylinder used to provide a measured amount of ink to a printing plate. The ink may be, for example, water-based or ultraviolet (UV)-curable inks. In one example, a first roller transfers ink from an ink pan or a metering system to a meter roller or anilox roll. The ink is metered to a uniform thickness when it is transferred from the anilox roller to a plate cylinder. When the substrate moves through the roll-to-roll handling system from the plate cylinder to the impression cylinder, the impression cylinder applies pressure to the plate cylinder which transfers the image on to the relief plate to the substrate. In some embodiments, there may be a fountain roller instead of the plate cylinder and a doctor blade may be used to improve the distribution of ink across the roller.

Flexographic plates may be made from, for example, plastic, rubber, or a photopolymer which may also be referred to as a UV-sensitive polymer. As used herein the term photopolymer refers to a polymer sensitive to light and that changes its properties when exposed to light, usually in the ultraviolet spectrum. The plates may be made by laser engraving, photomechanical, or photochemical methods. The plates may be purchased or made in accordance with any known method. The preferred flexographic process may be set up as a stack type where one or more stacks of printing stations are arranged vertically on each side of the press frame and each stack has its own plate cylinder which prints using one type of ink and the setup may allow for printing on one or both sides of a substrate. In another embodiment, a central impression cylinder may be used which uses a single impression cylinder mounted in the press frame. As the substrate enters the press, it is in contact with the impression cylinder and the appropriate pattern is printed. Alternatively, an inline flexographic printing process may be utilized in which the printing stations are arranged in a horizontal line and are driven by a common line shaft. In this example, the printing stations may be coupled to curing stations, cutters, folders, or other post-printing processing equipment. Other configurations of the flexo-graphic process may be utilized as well.

In an embodiment, flexoplate sleeves may be used, for example, in an in-the-round (ITR) imaging process. In an ITR process, the photopolymer plate material is processed on a sleeve that will be loaded on to the press, in contrast with the method discussed above where a flat plate may be mounted to a printing cylinder, which may also be referred to as a conventional plate cylinder. The flexo-sleeve may be a continuous sleeve of a photopolymer with a laser ablation mask coating disposed on a surface. In another example, individual pieces of photopolymer may be mounted on a base sleeve with tape and then imaged and processed in the same manner as the sleeve with the laser ablation mask discussed above. Flexo-sleeves may be used in several ways, for example, as carrier rolls for imaged, flat, plates mounted on the surface of the carrier rolls, or as sleeve surfaces that have been directly engraved (in-the-round) with an image. In the example where a sleeve acts solely as a carrier role, printing plates with engraved images may be mounted to the sleeves, which are then installed into the print stations on cylinders. These pre-mounted plates may reduce changeover time since the sleeves can be stored with the plates already mounted to the sleeves. Sleeves are made from various materials, including thermoplastic composites, thermoset composites, and nickel, and may or may not be reinforced with fiber to resist cracking and splitting. Long-run, reusable sleeves that incorporate a foam or cushion base are used for very high-quality printing. In some embodiments, disposable "thin" sleeves, without foam or cushioning, may be used.

The systems and methods disclosed herein leverage ink properties such as viscosity along with processing parameters and machine settings related to pressure, line speed, component selection (i.e. ink roll, anilox roll selection) and flexo-master design to produce microscopic uniform printed patterns. phenomena that may be referred to as "dot gain" may cause printed material to be larger or different than intended, in some cases because the ink has a smeared appearance which may also indicate that the pattern intended during printing has not printed uniformly, completely, or a combination of both. Dot gain may be due to a combination of factors including contact pressure between the printing plate cylinder that has the flexo-master and the substrate, from the insufficient or excessive transfer of ink, machine temperature at transfer/contact areas, ink viscosity, and ink composition. As such, the present disclosure leverages this phenomenon in the design of flexo-masters which may be capable of printing high resolution patterns which, as discussed above, may comprise lines with widths larger than 50 microns, smaller than one micron (sub-micron-size), as well as sizes in between 1 micron and 50 microns. In some embodiments, these printed patterns may be further processed, which may be costly processing that lends itself to clearly and uniformly printed patterns. In other embodiments, the printed patterns may be used as-is or shelved for potential further processing so the pattern stability may also considered.

FIG. 1 illustrates an exemplary flexo-printing process that may be capable of implementing embodiments of the present disclosure. The flexographic printing system 100 may comprise an ink pan 102 or other ink source, a fountain roll 104 or ink roll, an anilox roll 106 or meter roll, a printing plate cylinder 108, an impression cylinder 112 or NIP roll, and a doctor blade 114 to remove excess ink, which may be used in combination to print a substrate 116. The ink roll 104 transfers ink 120 from the ink pan 102 to the anilox roll 106. The anilox roll 106 may be constructed of a steel or aluminum core which is coated by an industrial ceramic whose surface contains millions of very fine dimples, known as cells. The anilox roll 106 may be selected to transfer a specific volume of ink 120 depending upon the pattern configuration and ink type and viscosity as well as other machine setup parameters.

In an embodiment, the doctor blade 114 may remove the excess of ink on the anilox roll 106 which meters the ink to a uniform thickness onto printing plate cylinder. A flexo-master 110 may be disposed on the printing plate cylinder 108 which is used to print a pattern on the substrate 116. The flexo-master 110 may be disposed on/affixed to the printing plate cylinder using adhesive on at least one of the flexo-master 110 and the printing plate cylinder 108, or by mechanical means, thermal means, chemical means, or combinations thereof. In some embodiments, more than one printing plate cylinder 108 may be used to print a single pattern on a substrate. In this embodiment, a plurality of flexo-masters 110 may be disposed, one on each printing plate cylinder 108, and more than one composition and/or viscosity of ink 120 may be used. In other embodiments, a plurality of flexo-masters 110 may be used to print more than one pattern on the substrate 116 which may be further processed into individual segments. It is appreciated that the printing may occur on one side of the substrate 116 or on both sides of the substrate 116 depending upon the end application of the printed pattern(s). The substrate 116 may move between the plate cylinder 108 and the impression cylinder 112. The impression cylinder 112 may apply pressure to the plate cylinder 108, thereby transferring an image in ink 120 from the flexo-master on to the substrate. The rotational speed of the plate cylinder 108 may be synchronized to match the speed at which the substrate 116 is moving through the flexographic printing system 100, which may also be referred to as a roll-to-roll handling system. In some embodiments, the speed may vary between 20 feet/minute and 2,600 feet/minute. The flexo-master may comprise any or all of the junction, discontinuous line, or other flexo-master features and/or methods of utilizing the combination of at least the flexo-master features, ink viscosity, and machine pressure to deposit ink in a flexo-graphic printing process in only the intended areas, which may also be referred to as uniform printing or uniform pattern printing, and to not deposit ink in unintended areas on the substrate 116. In an embodiment, the intended areas on the substrate 116 may be referred to as a plurality of locations associated with the flexo-master pattern 110.

In an embodiment, the plate cylinder 108 may be made of metal, and the surface of the plate cylinder may be plated with chromium, for example, for the purpose of increasing abrasion resistance. The substrate 116 may be a printable substance such as polyethylene terephthalate (PET), High-density polyethylene (HDPE), linear low-density polyethylene (LLDPE), biaxially-oriented polypropylene (BOPP), polyester, polypropylene, foam sheets, paper, aluminum foil, other metallic foil, or thin glass. It is appreciated that polyethylene terephthalate (PET), as used herein refers to a melt-phase PET resin, for example a reactor-grade polyester or polyester chip, that may be the polymer used in the production of polyester family and used in engineering resins often in combination with glass fiber. In certain instances, the PET or PET films are heat stabilized and may or may not have adhesion promotion coatings. A polymer substrate as discussed herein for the substrate 116 may be an acrylate which can be optically clear. In one example, the substrate 116 may have a maximum thickness of about 0.50 mm.

FIG. 1 also illustrates a contact printing area 118 which may comprise the plate cylinder 108, the impression cylinder 112, the flexo-master 110, the substrate 116, and the ink transfer area 122. The ink transfer area 122 may comprise the anilox roll 106, the flexo-master 110, and the printing plate cylinder 108. It is appreciated that, for embodiments where more than one printing plate cylinder 108 is used, there may be more than one ink transfer area 122 and/or contact printing area 118.

Figure 2:
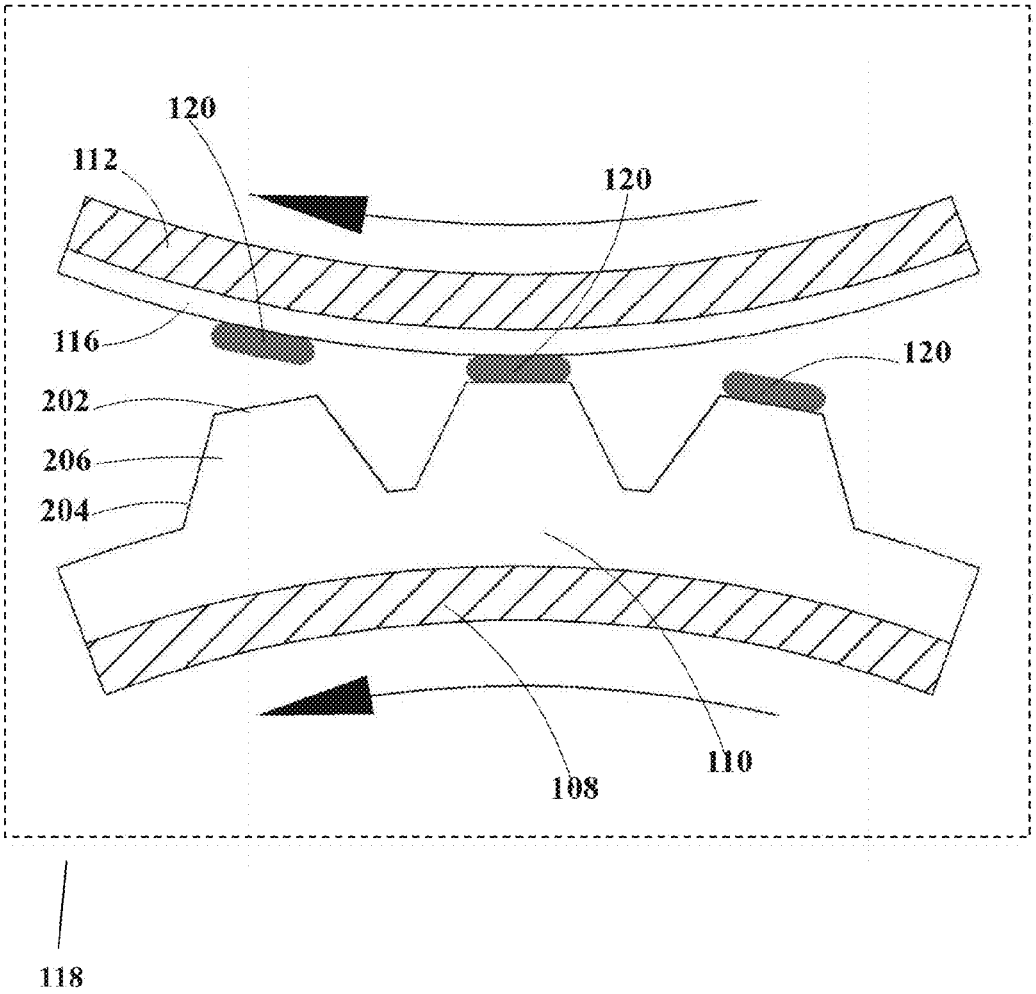
FIG. 2 is an illustration of an expanded view of a cross-section of a contact printing area.

FIG. 2 is an illustration of an expanded view of a cross-section of a contact printing area. A contact printing area 118 as discussed in FIG. 1 is the area where the flexo-master 110 is in contact with the substrate 116. A raised printing surface 202 of the lines 206 that comprise a pattern to be printed may be engraved on flexo-master 110 and may exhibit angled sidewalls 204. In an alternate embodiment (not pictured) the lines 206 may be recessed. Ink 120 is transferred from an ink source to, for example, an anilox roll to the raised printing surface 202 to a substrate 116 when an impression cylinder 112 presses the substrate 116 against printing surface 202 while the plate cylinder 108 and the impression cylinder 112 may be synchronously rotating. This contact printing area 118 is illustrated as an example of a preferable embodiment wherein the ink 120 is picked up by the raised pattern line 206 and transferred in a clean, precise, uniform, and repeatable fashion to the substrate 116 and may be contrasted with, for example, FIGS. 4A and 4C.

Figure 3:
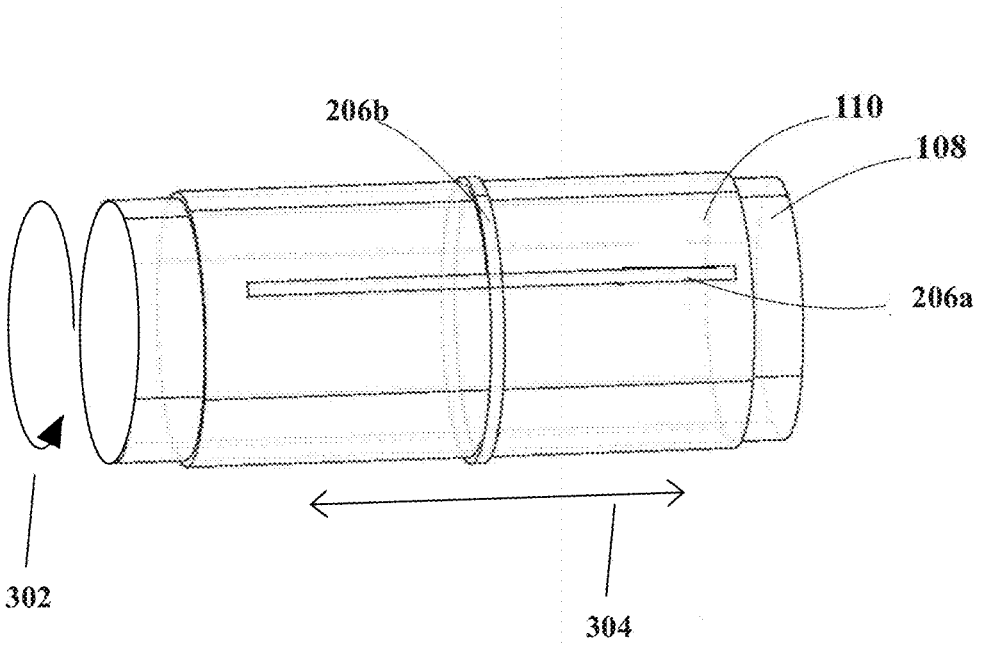
FIG. 3 illustrates a transverse direction (T) and a machine direction (M) for a roll to roll flexographic printing system according to embodiments of the present disclosure.

Flexo-Master Pattern Orientations: FIG. 3 illustrates a transverse direction (T) and a machine direction (M) for a roll to roll flexographic printing system according to embodiments of the present disclosure. In some embodiments, the present disclosure relates to flexo-master patterns oriented with respect to the rotational direction of the plate cylinder 108. FIG. 3 shows a line 206*a* oriented in the transverse direction 304 (T) and a line 206*b* oriented in the machine direction 302 (M) oriented lines 206 on the flexo-master 110. It is understood that the lines 206*a* and 206*b* are representative of a plurality of lines forming a pattern or patterns that may ultimately be used as conductive patterns for applications including, but not limited to, touch screen and RF antenna applications, and that discussion of a line in a particular direction is representative of a pattern in the same direction. In a flexo-master 110 with the transverse direction 304 oriented line 206*a*, all of the ink 120 may be transferred as the result of the discrete impact of the printing surface 202 when it comes in contact with the substrate 116. In a flexo-master 110 with the machine direction 304 oriented line 206*b*, the printing surface 202 may be preferably continuously in contact with substrate 116 and the ink 120 may be transferred onto the substrate 116 for the length of the lines 206*b* as the plate cylinder 108 rotates. It is appreciated that the ink 120 is comprised of one or more droplets of liquid that adhere to the printing surface 202 of the lines 206*a* or 206*b* on the flexo-master 110.

Figure 4:
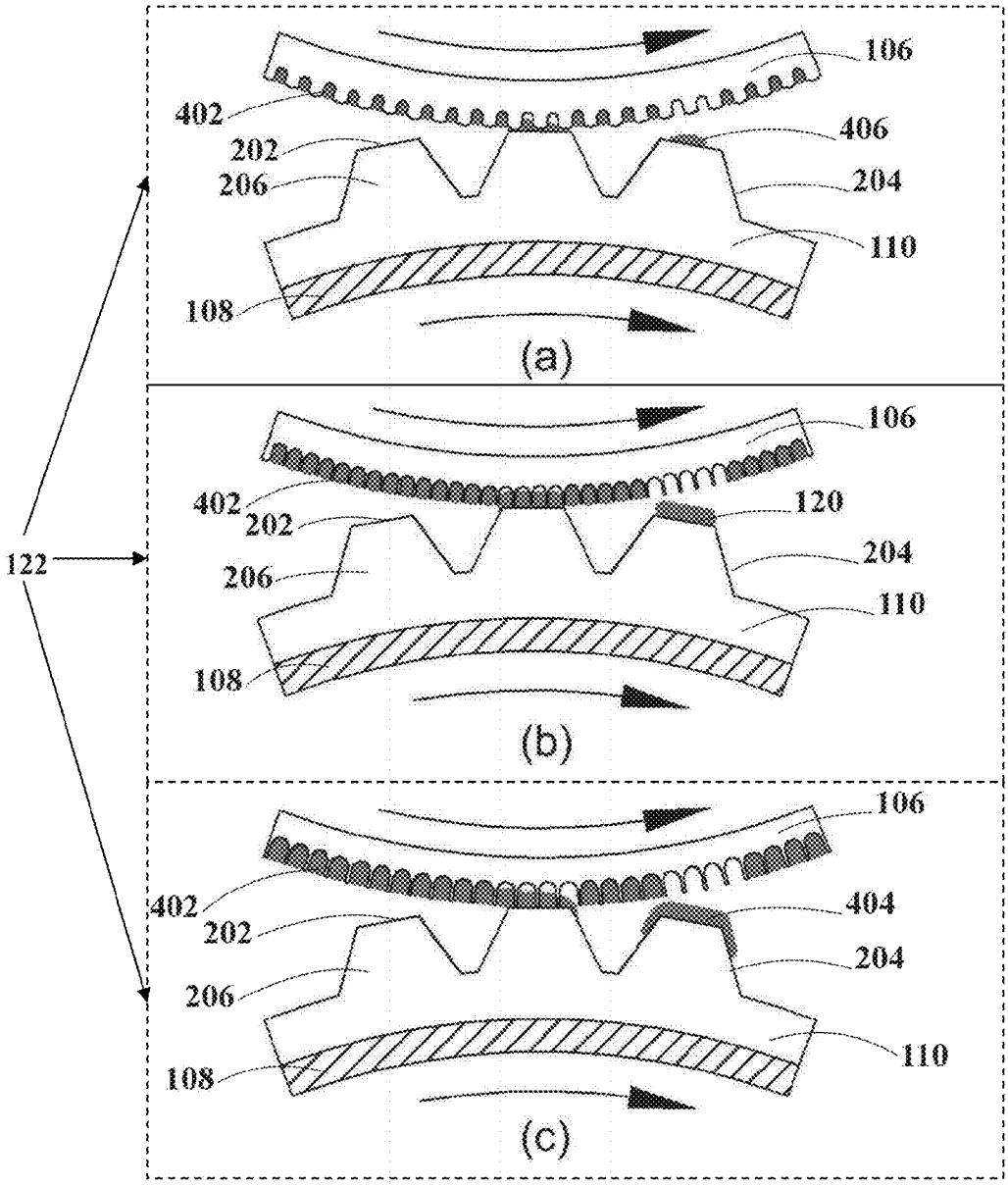
FIGS. 4A-4C illustrate exploded cross-sectional views of ink transferring areas.

Ink Transfer Volume: FIGS. 4A-4C illustrate exploded cross-sectional views of ink transferring areas. FIGS. 4A-4C show ink transfer by the anilox roll 106 to the flexo-master 110 within ink transferring areas 122 as shown in FIG. 1. In an embodiment, the anilox roll 106 may have some control over the amount of ink 120 that is transferred based on the cell size of anilox roll 106, that is, different sizes of cells 402 transfer different volumes of ink to flexo-master 110. In FIG. 4A, when an insufficient amount 406 of ink 120 is transferred from the anilox roll 106 to the lines 206 on the flexo-master 110, there may not be enough ink 120 transferred to either the lines 206 and/or the printing surface 202 to form a uniform, dimensionally in-tact pattern. As used herein, a dimensionally in-tact or dimensionally correct pattern refers to the uniform pattern printed discussed above where ink is only deposited in intended locations and is not deposited in unintended locations. This pattern may be made to a predetermined set of customer specifications, internal specification, regulatory requirements, or combinations thereof. This may also be referred to as a uniformly printed pattern or uniform pattern.

The transfer of an insufficient amount of ink as illustrated in FIG. 4A may result in insufficient pattern printing, which may result in scrap and/or the inability to further process the printed pattern and/or a defunct intermediate or final product that includes the printed pattern. By controlling and varying printing factors as discussed herein, a desired width for printed lines or features may be achieved using the flexo-master 110 designs described herein. The printing factors that may be varied include print speed, pressure, ink viscosity and volume of ink transferred (anilox roll). As discussed herein, some properties of ink such as the viscosity and volume may be leveraged by the design and design direction of the flexo-master 110 to take advantage of properties such as bleeding to form complete, uniform patterns.

Conversely, as shown in FIG. 4C, if the amount of ink 120 transferred onto the lines 206 on flexo-master 110 is too large to be contained solely on the printing surface 202, the excess ink 404 may spread out and adhere to a portion of the angled sidewall 204 immediately adjacent to printing surface 202 of lines 206. It is appreciated that this may be a concern because if the ink is unintentionally forced onto the sidewall 204, that may mean that the pattern is not printed uniformly on the substrate 106. In addition, if one or more lines 206 from the pattern on the flexo-master 110 has excess ink 404 in at least the sidewall location, this which may cause a problem as the printing process continues, resulting in clumping and/or the flexomaster not being able to hold the correct amount of ink. In an embodiment discussed below in FIG. 9, the use of excess pressure may be leveraged to produce two separate printed lines from one flexo-master line 206. And finally, FIG. 4B depicts what may be a preferred embodiment of ink transfer from the anilox roll 106 to the flexo-master 110, as demonstrated by the ink 120 being transferred on to the substrate 106 completely and uniformly.

Figure 5:
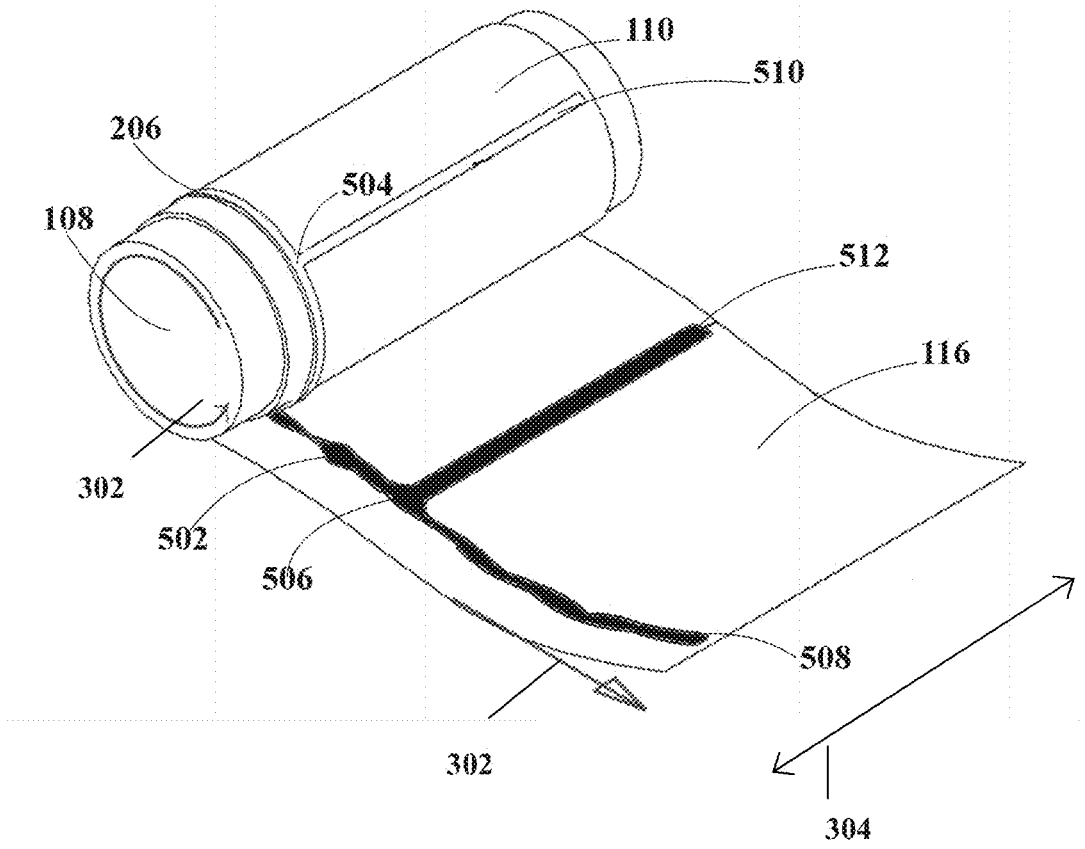
FIG. 5 is an illustration of a substrate flexo-graphically printed with excess ink.

FIG. 5 is an illustration of a substrate flexo-graphically printed with excess ink. FIG. 5 illustrates results such as those that may be caused by the excess ink 404 described in FIG. 4A. Just as insufficient ink is the term used herein to describe when a pattern is not printed uniformly (when a pattern is printed with ink in unintended areas/locations or when ink is missing in intended locations—i.e. when there are gaps or other locations of missing ink) and/or correctly at least in part due to the amount of ink transferred, excess ink is the term used herein to describe the reverse problem, that is, when a pattern is not uniformly printed because more ink is transferred than is needed to print the desired pattern dimensions and geometry. The representative line 206 in the machine direction 302 (M) and the line 510 in the transverse direction 304 (T) may form a cross pattern 504 on the flexo-master 110. When printing a lines 206 in the machine direction 302, at the point of contact between flexo-master 110 and substrate 116, the ink 120 that is still on flexo-master 110 may come in contact with both the substrate 116 and, potentially, a portion of the ink 120 that has already been transferred to the substrate 116. If there is excess ink 404 at this point of contact, then the ink 120 may be pushed forward as the lines 206 in the machine direction 302 and transverse direction 304 continue to rotate in contact with substrate 116.

This excess ink 404 may spread out as extra width of the printed line, continually making the edge of the printed line to appear to have a sinusoidal type shape 502 (i.e. may look like beads on a necklace), or it may accumulate in the cross pattern 504 or at similar junctions as discussed below. At this point, the entire volume of the excess ink 404 may be deposited at once, producing excess ink at crossover points 506. Alternatively, or in addition to this issue, the length of the printed line 206 may be extended, producing an ink appendage 508 after the lines 206 in the machine direction 302 (M) ends. In addition, the excess ink 404 may result in printed lines such as line 512 that may not have the shape issues of 508 but may be significantly wider (i.e. out of spec for a desired application) than the patterned lines 510 were designed to print. In an embodiment, these lines may be wider than the flexo-master line 510 by possibly as much as 10 times the line width of patterned lines 510 on flexo-master 110, and are therefore may not be desirable as the flexo-master 110 is designed to produce lines with certain dimensional specifications that may not have a 10× or +/−5× width tolerance. It is appreciated that, in addition to issues with width, the length as well as height of the printed patterns may be adversely affected by the issues discussed above.

Figure 6:
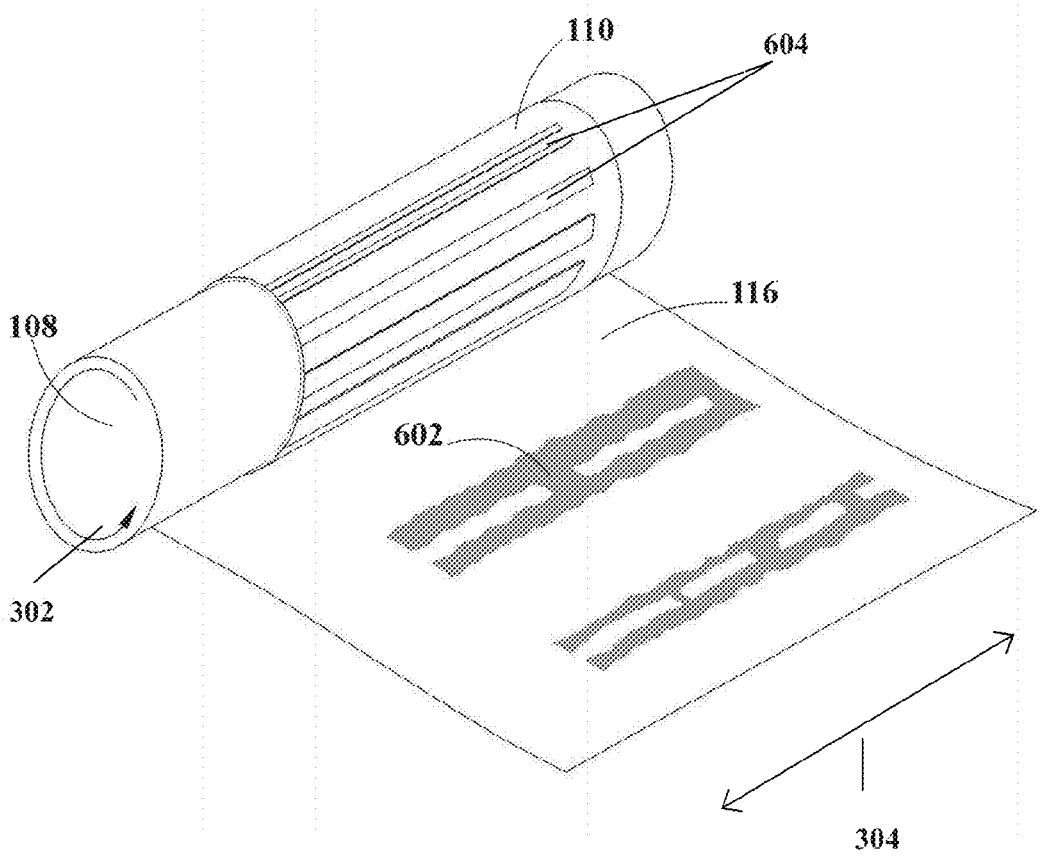
FIG. 6 is an alternate illustration of a substrate flexo-graphically printed with excess ink.

FIG. 6 is an illustration of a substrate flexo-graphically printed with excess ink. As used herein, the term "excess ink" is used to describe a condition when more ink that is needed to print a pattern is transferred from the ink source to the anilox roll and/or from the anilox roll to the printing plate cylinder 108 and/or from the printing plate cylinder 108 to the substrate 116. The excess ink 404 on one or more of the flexo-master lines 604 could merge when printed to form a bridge-like feature which may completely obfuscate the original intended patterned lines 604. That is, two printed lines 602 printed by two separate lines 604 on the flexo-master may be misshaped and/or merge together in part as shown at 602, this may not produce the desired uniform printed pattern and may cause the product to be scrapped. In some embodiments, scrap has cost, labor, and environmental implications which further impresses the desire to be able to print uniform patterns, where ink is only deposited in intended areas and is not deposited in unintended areas, on a repeatable basis with high resolution lines. As flexo-masters are designed to print patterns of lines with a certain width, length, height, and joiner feature size for each line or set of lines, it is understood that it is desirable to have none of the uncontrolled effects depicted in FIGS. 5 and 6. Instead, for example, using systems and method disclosed herein print clear, uniform patterns on a consistent, repeatable basis for cost effective manufacturing and end product reliability as well as intermediate post-printing processing. It is appreciated that, in some embodiments, printed patterns may be further cleaned, plated, cured, or otherwise treated, as discussed further in FIG. 14, so a poorly printed pattern may have even more of an impact on downstream processing.

Figure 7:
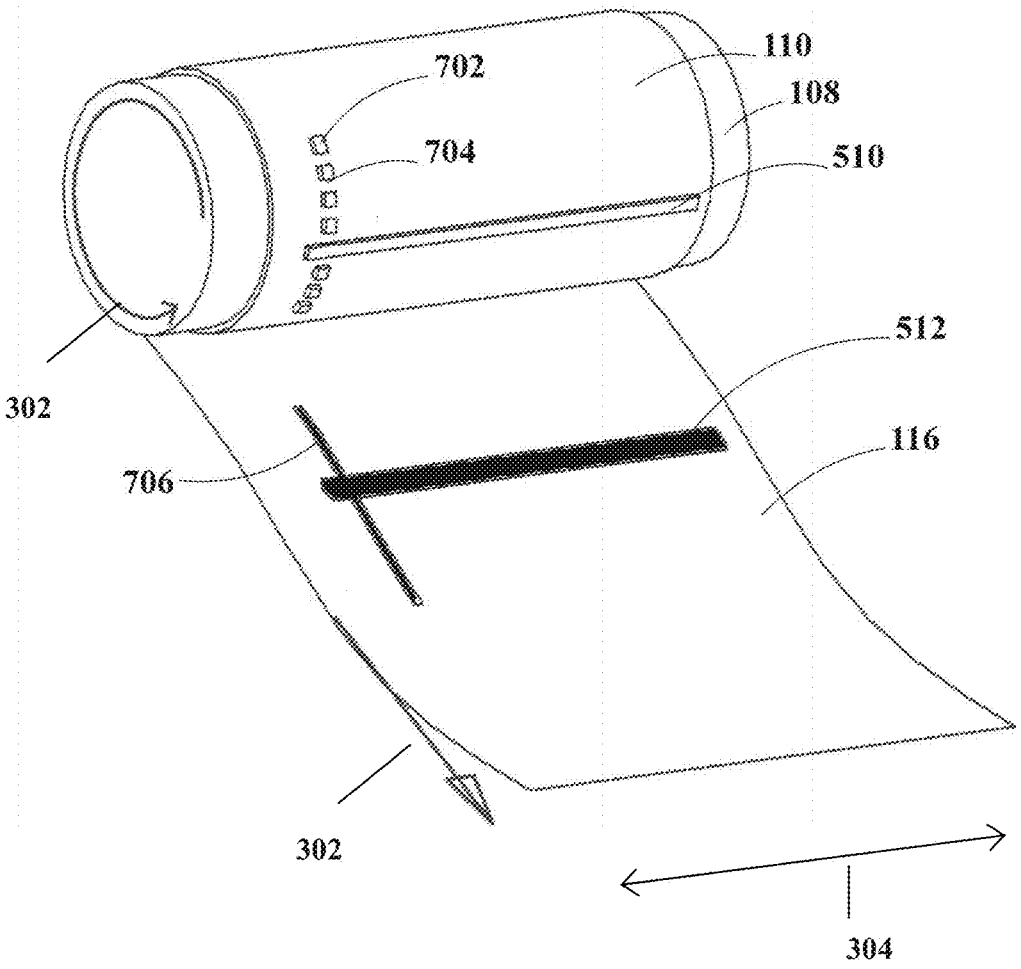
FIG. 7 is an illustration of a substrate printed according to embodiments of the present disclosure.

Therefore, to aid in reducing the effect in at least FIG. 6, instead of making the lines 206 using continuous patterned lines 604 at angles that are near parallel to the machine direction 302 (M), it may be better to use non-continuous patterned lines 702 (dotted or dashed lines, or gaps in the lines) as shown in FIG. 7 and discussed in detail below. It may also, in some embodiments, be desirable to leverage the effects shown in FIG. 6 to produce lines in a controlled fashion using the combination of printing parameters, ink properties, and flexo-master design as discussed above to use two or more lines 206 or features on a flexo-master 110 to form a single line or feature on the substrate 116. In this embodiment, the two or more lines used may be of the same dimensions, similar dimensions, differing dimensions, or a combination thereof with respect to the height, width, length, and shape of the two or more lines on the flexo-master 110.

FIG. 7 is an illustration of a substrate printed according to embodiments of the present disclosure. The printed example line 706 results from a non-continuous patterned line 702 on the flexo-master 110. The non-continuous (or discontinuous) patterned line 702 as discussed herein may be comprised of a plurality of uniform or non-uniform sections along a single direction or (not pictured) along more than one direction. A uniform section is one with approximately the same length, width, and height dimensions of other dimensions, and a non-uniform section may have differing dimensions, a discontinuous line 702 may comprise some sections that are uniform with respect to each other but that may differ with respect to other sections. In an embodiment, a discontinuous line 702 comprises only uniform sections, and in an alternate embodiment the discontinuous line 702 comprises only non-uniform sections, and in another embodiment the discontinuous line 702 may comprise a combination of sections some of which have at least one of the same or similar height, width, and length. The line sections, which may also be referred to as segments, of line 702 may be, from a top view perspective, rectangular, square, circular, polygon, or combinations thereof as appropriate for printing the desired line or lines. Splitting what would be a continuous line on a flexo-master 110 into multiple sections as shown in the discontinuous line 702 may relieve the sinusoidal printing issue that may result from the excess ink 404 as described in FIGS. 5 and 6. By putting a gap spacing 704 between sections of the non-continuous patterned line 702 on the flexo-master 110, continuous features or lines 706 may actually printed when the ink 120 merges together on the substrate 116.

In contrast to the accidental merging shown in FIG. 6, the merging in FIG. 7 may be controlled by the design of the flexo-master as well as by the ink and machine setting factors/properties discussed above to form portions of a pattern. The gap spacing 704 required for a line 206 or other feature comprised of more than one line 206 or by a transition between a line or lines 206 may vary in accordance to printing factors such as printing speed, viscosity of ink 120, pressure between flexo-master 110 and substrate 116, volume of ink 120 that anilox roll 106 transfers to flexo-master 110, and surface energy of substrate 116. Determining the proper gap spacing 704 can be accomplished by selecting a specific combination of the above printing factors such as ink viscosity, end pattern dimensions, pressure, etc., and printing transverse oriented 304 lines. The actual width of the wide printed line 512 when compared to the width of the pattern line 510 will define the maximum gap spacing 704. The gap spacing 704 may be used to define the requirements and the adjustments to the original pattern design to make the lines 206 on the flexo-master 110. In another embodiment, a high precision flexo-master for making printed electronic patterns comprises lines printed in machine direction where the lines are non-continuous patterns. In this embodiment, if a 10 μm wide line on the flexo-master prints a 40 μm wide line on the substrate 116, which is 30 μm wider than the original patterned line, then the gap spacing in the pattern on the flexo-master may be made with less than a 30 μm gap between every line segment in order to obtain a continuous printed line. During the printing process, the excess ink merges together on the substrate, closing the gaps and providing a continuous printed line 706.

Figure 8:
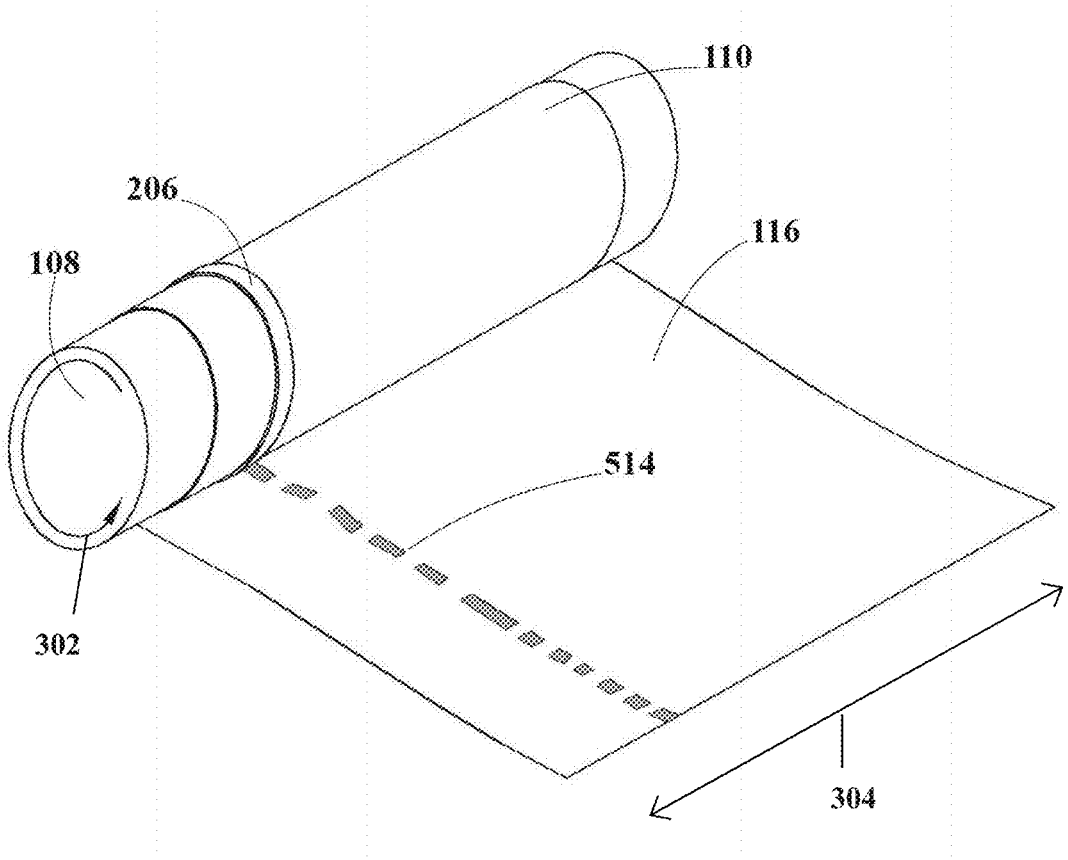
FIG. 8 is an illustration of a substrate flexo-graphically printed with insufficient ink.

FIG. 8 is an illustration of a substrate flexo-graphically printed with insufficient ink. FIG. 8 is shown to illustrate what type of printed line may result from insufficient ink 406 transfer during any part of the transfer process. As discussed above, the insufficient ink 406 may result from a number of factors including flexo-master design, in particular if the flexo-master 110 has ink on the sidewalls 204 as discussed in FIG. 4C or if the flexo-master 110 is not a uniform height on the pattern surface, i.e. if the lines or features of the pattern are of varying heights such that all of the pattern lines are not sufficiently covered in ink prior to printing. If the insufficient ink 406 on the printing surface 202 of the lines 206 is transferred to the substrate 116, then non-continuous printed lines 514 may be formed. Moreover, the amount of pressure applied towards pushing the flexo-master 110 into contact with substrate 116 may affect the amount of ink 120 transferred from the lines 206 on the flexo-master 110 and may also therefore have an effect on the resulting printed pattern of ink 120 transferred to the substrate 116. In some embodiments, a combination of insufficient ink 406 volume and light pressure may result in a printed line width most closely matching the pattern on flexo-master 110. However, there may be irregularities in the top surface of flexo-master 110 which may result in gaps or breaks in the printed pattern.

Figure 9:
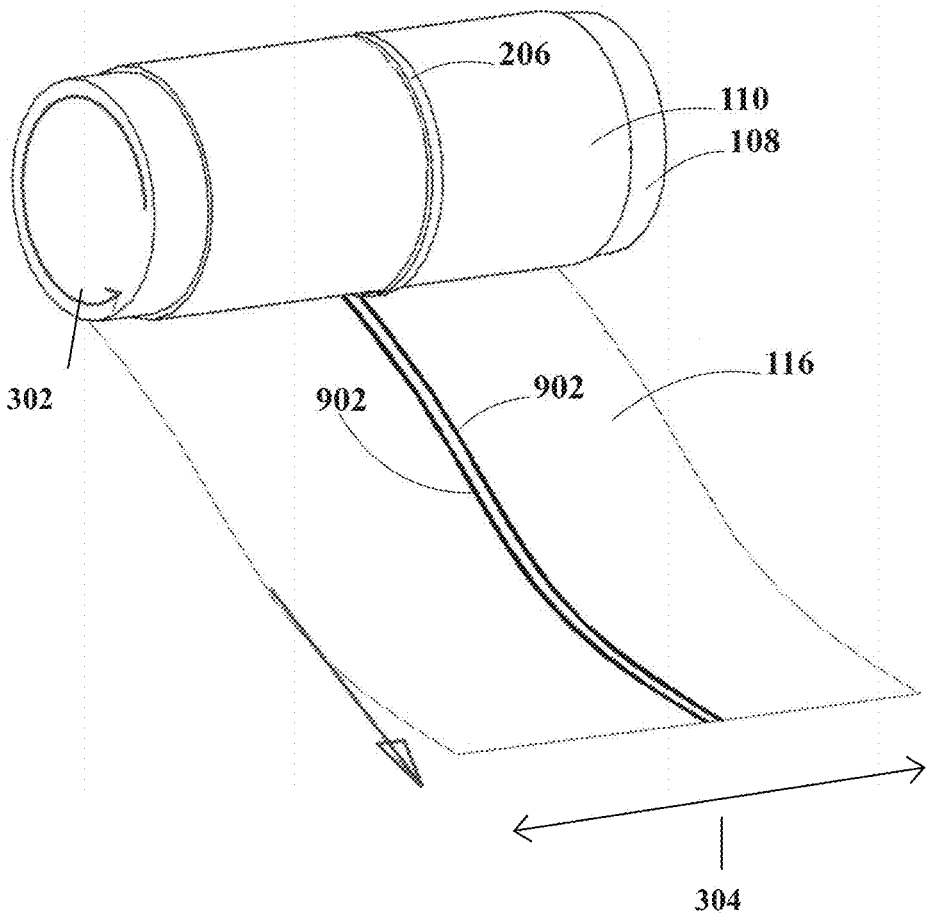
FIG. 9 is an illustration of the effect that excess pressure between the flexo-master and the substrate may have on printing.

Pressure Variations: FIG. 9 is an illustration of the effect that excess pressure between the flexo-master and the substrate may have on printing. In this example, the use of the ink 120 with increased pressure, for example, between the substrate and the flexo-master that may be caused by an imprinting roll, results in a printed pattern of lines 902 that, whose total combined width is significantly wider than the original lines 206 on the flexo-master 110. As discussed above, the flexo-master 110 may be designed to print patterns with lines of specific dimensional tolerances so the wider lines may not be desirable. In FIG. 9, the pattern to be printed is a continuous line 206 in machine direction 302 (M). However, when the flexo-master 110 is pushed into contact with substrate 116 with excessive pressure, all of the ink 120 is forced to the angled sidewalls 204 of the lines 206. The printed pattern from this printing operation is essentially two distinct printed lines 902 that are separated by a space that corresponds approximately to the width of the printing surface 202 of the lines 206 on flexo-master 110. To achieve the desired lines 206 or feature widths, in the printed pattern, a precise combination of ink 120 volume and pressure may be used. In some embodiments, the flexo-master designs as discussed herein may print patterns with line widths over 50 microns or later, and in other embodiments the flexo-master designs may print patterns comprising line widths smaller than one micron (sub-micron sized lines), and in an alternate embodiment the line widths may be in between 1 micron and 50 microns.

Figure 10:
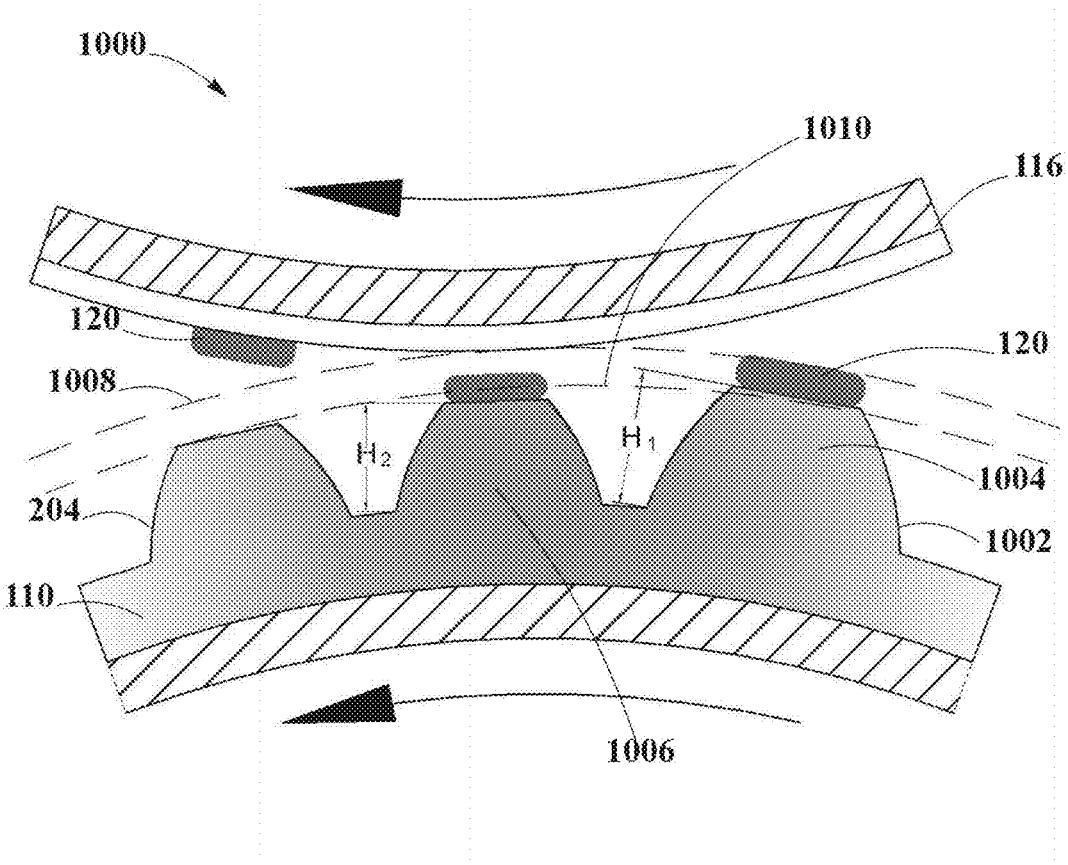
FIG. 10 is an illustration of the effect of flexo-master swelling in a flexographic printing system.

Swelling: FIG. 10 is an illustration of the effect of flexo-master swelling in a flexographic printing system. FIG. 10 shows how the swelling of flexo-master 1000 affects feature height and printing performance. FIG. 10 illustrates the example of volumetric swelling 1002 of a tall patterned lines 1004 on the flexo-master 110, more specifically shown as bulging when compared to angled sidewall 204. The flexo-master 110 may be very flexible and may absorb moisture from high humidity and contact fluids such as the ink, adhesives, and other machine fluids. As a result of this absorption, the flexo-master 110 volumetrically swells, producing a distortion of the printed features, including changes to length, width, height, and shape of printed features, as well as height differential of various features depending on the volumetric cross section. Generally, tall patterned lines 1004 exhibits height (H1) higher than short patterned lines 1006 height (H2). The ink 120 on tall patterned lines 1004 rotates across tall feature arc 1008, while ink 120 in the short patterned lines 1006 rotates across the short feature arc 1010. In this scenario, due to the height differential between 1008 and 1010, most, if not all of the ink 120 from the short patterned lines 1006 may not be properly transferred to the substrate 116 during the printing process and the desired uniform pattern may not be printed on the substrate 116. The height differential of various features in the flexo-master 110 may be caused by the fact that if there is a mass differential under a given point/portion of lines 206. In this case, lines 206 may swell from the absorption of moisture and the tall patterned lines 1004 may swell more than the short patterned lines 1006 because there is more volume of material under the higher density tall patterned lines 1004. In the methods disclosed herein, swelling may be accounted for by both flexo-master design as well as ink selection, machine parameter selection, and machine component selection, for example with respect to anilox rolls.

Figure 11:
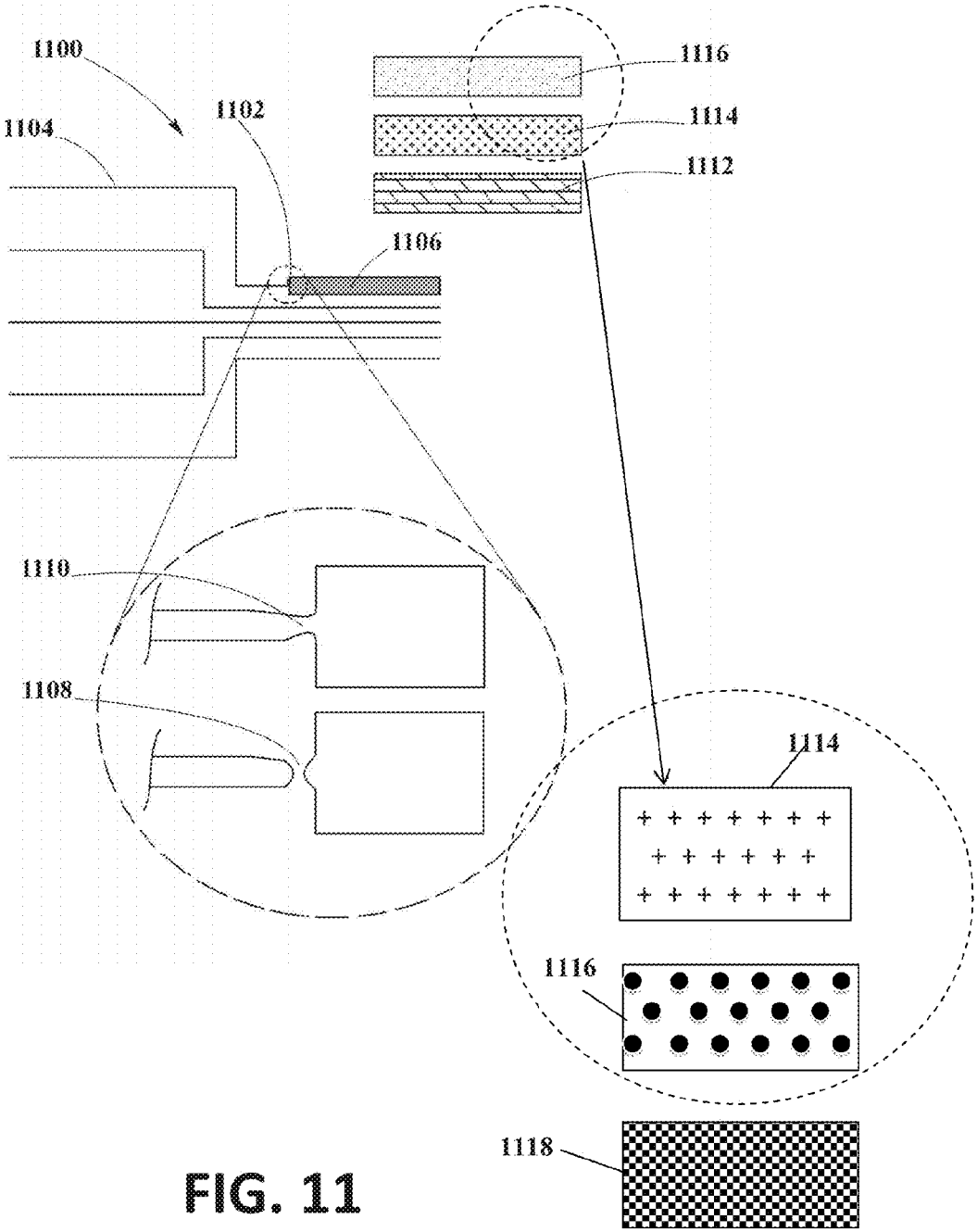
FIG. 11 illustrates exemplary results from a flexo-master pattern design with a junction between small and large features according to embodiments of the present disclosure.

FIG. 11 is an illustration of embodiments of a patterned line design with line fill patterns. A line fill pattern is the term used to describe when a pattern line or lines on a flexo-master 110 are texturized with one or more textures as discussed below and shown for effect in exploded views to assist pattern printing uniformity and promote ink deposition in intended locations and not in unintended locations. When a pattern is printed by a pattern design 1100 on, for example, a flexo-master 110 as discussed above, there may be different line widths that may need to be connected to each other at an intersection (junction), 90 degrees or otherwise, or in a corner, or in another transitional area and/or with a transitional geometry. In an embodiment, it may be desirable to have these connected/transitional areas formed on the flexo-master without a potential height differential between the lines that may cause problems in the pattern continuity as discussed above in FIG. 10. A height differential may cause a printing issue, for example, when a set of printed lines produced by a plurality of tall patterned lines 1004 must connect to a set of printed lines produced by a plurality of short patterned lines 1006. Tall patterned lines 1004 may swell more as compared to shorter patterned lines 1006, becoming higher than the short patterned lines 1006. When this happens, there may be a gap in the printed pattern at the point the short patterned lines 1006 connect to taller features (or wider) lines due to height differential between the two sets of lines or features. In certain instances, wider lines or features may be replaced with multiple smaller lines or features near the same width as the smaller lines or features that need to be connected so that various printing issues can be minimized. If no adjustment in the printing pattern is made, the transitional area 1102 connecting the small patterned lines 1104 and large patterned lines 1106 may have either a complete break 1108 in the printed pattern or a reduction (or necking 1110) in the printed width of the smaller line or feature at the junction/intersection/transition of features.

In an embodiment, when printing the very large patterned lines 1106, for example, lines greater than 50 μm wide, there may be an issue with the uniformity of the printed ink 120. The ink 120 may tend to attempt to form spheres (or bead up) due to surface tension of the ink 120 depending on the surface energy of the flexo-material. This can lead to a non-uniform distribution (both thickness and area) of ink 120 over the surface of large patterned lines 1106 on the flexo-master 110 before and after it is printed to substrate 116. This can create a non-uniform distribution of ink, in both thickness and area, of the printed ink 120 on substrate 116.

Such non-uniformity of the ink 120 can cause problems with the conductivity or resistivity of a printed conductive pattern, and/or may impact further processing of that printed pattern. Illustrations 1112, 1114, and 1116 are of various fill patterns of a line. To clarify the fill patterns for 1114 and 1116, FIG. 11 contains an exploded view of those patterns as well as a checkered pattern 1118. In contrast to a flexo-master pattern that comprises a plurality of lines as discussed above, a fill pattern is the term used to describe the pattern that may be on some of all of the lines of the pattern on the flexo-master designed to print lines of varying widths on the substrate. That is, one, some, or all of the lines on the flexo-master may be patterned as shown in 1112, 1114, and 1116 in various combinations so that the printed ink pattern is sufficiently (dimensionally) and uniformly (consistency among and between patterns) filled. The examples of pattern fill in 1112, 1114, and 1116 are illustrative and other fill patterns and combinations of fill patterns are possible depending upon the application.

In an embodiment, non-uniform printing may be addressed by either printing multiple thin lines forming a brick fill pattern 1112 grid of thin lines with multiple interconnects to achieve the equivalent of a single large patterned lines 1106 or to alter the pattern of the surface of large patterned lines 1106 pattern on the flexo-master 110 in order to more uniformly transfer ink 120 to the printed substrate 116. The exploded views of 1116 and 1114 are provided for illustration, it is appreciated that the features of the fill patterns in 1116, 1114, 1112, and 1118 may be oriented as shown, or at 45°, 90°, 180°, or otherwise as appropriate for the flexo-master design. In another embodiment, a single conductive large pattern line 1106 of up to 500 μm wide can be printed by using the brick fill pattern 1112 of 20 μm width with gaps of about 20 μm (actual gap value would be determined as previously described). Likewise, various fill patterns for large patterned lines 1106 can be used such as cross pattern fill pattern 1114 or dotted pattern 1116 instead of thin lines 1112. The actual size, shape and spacing values for these fill patterns will be determined from the values obtained from conducting print tests using a selected set of printing factors. In an embodiment, multiple flexo-masters 110 may be disposed on multiple printing plate cylinders 108 as shown in FIG. 1, and each flexo-master 110 may be used to print a portion of a single pattern. In that embodiment, the same ink 120 may be used for each portion of the pattern, or more than one ink 120 of varying composition or viscosity may be used to print the pattern. It is appreciated that, while 50 μm-wide or larger lines are discussed above, the fill patterns may be used on lines smaller than 50 μm, in which case, for example, the brick fill pattern may have dimensions of less than 20 μm.

Figure 12:
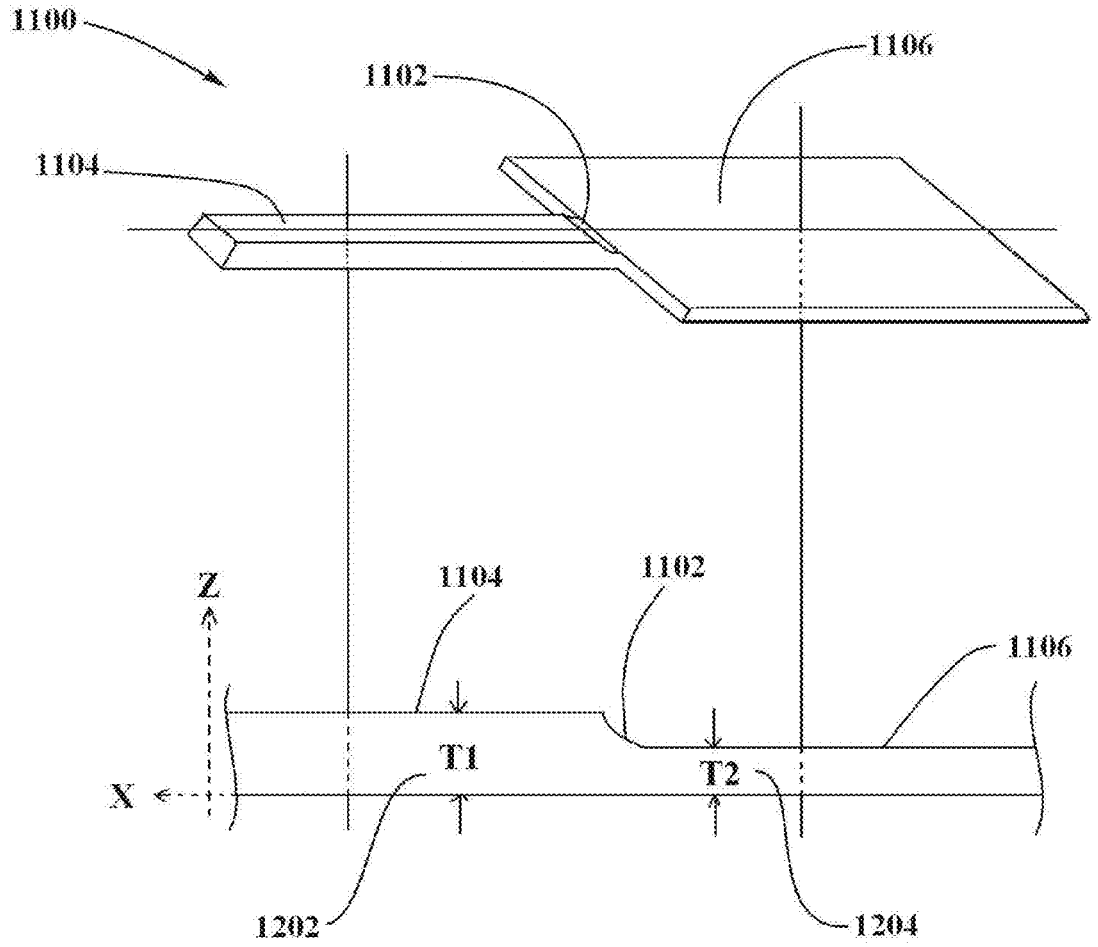
FIG. 12 illustrates a cross-sectional view and an isometric view of a flexo-master pattern design with a transitional area.

FIG. 12 illustrates a cross-sectional view and an isometric view of a flexo-master pattern design with a transitional area. FIG. 12 shows an isometric depiction of the flexo-master pattern design 1100 on the flexo-master 110 (not shown). The cross sections of the features on the flexo-master 110 are also shown. Section T1 comprises a plurality of lines 1202 and section T2 comprises a plurality of lines 1204. In an embodiment, the plurality of lines 1201 in section T1 may be smaller in, for example, width and/or height, than the plurality of lines 1202 in section T2. Sections T1 and T2 represent the height differential caused when the photo-polymer under the features cross links and shrinks during the UV exposure (patterning) step discussed above with respect to flexo-master manufacture. In an embodiment, the larger the volume of photo-polymer, represented by T2 and 1204, the greater the shrinkage due to the cross linking of the polymer. Therefore, a large patterned line 1106 has a shorter cross section T2 1204 than the cross section T1 1202 of the small patterned line 1104. Stated differently, wider lines on a flexo-master may have shorter heights as compared with thinner lines on the same flexo-master.

Figure 13:
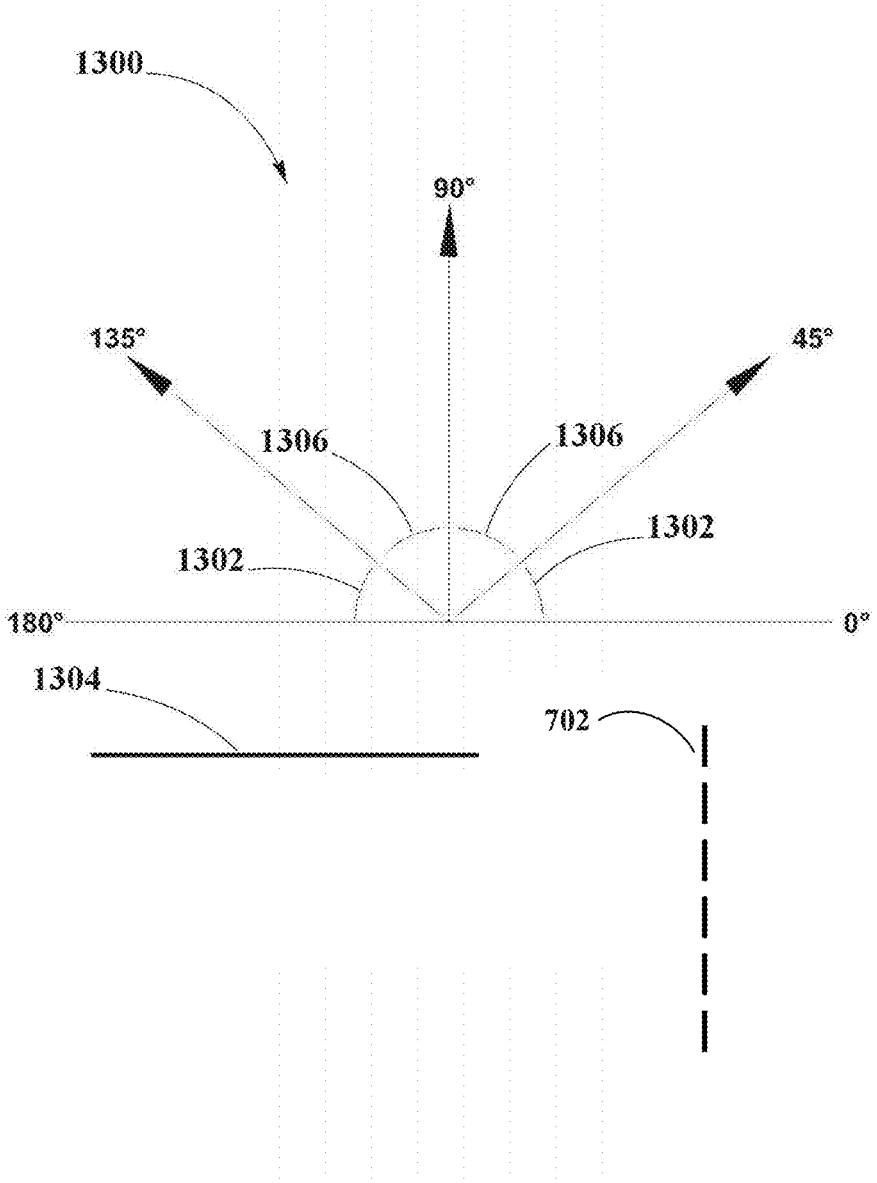
FIG. 13 illustrates a plurality of orientation ranges for flexo-master patterns according to embodiments of the present disclosure.

FIG. 13 illustrates a plurality of orientation ranges for flexo-master patterns according to embodiments of the present disclosure. FIG. 13 shows pattern styles 1300 for the lines 206 used to draw according to the orientation angle of printed lines on flexo-master 110. A CAD file is generated with a specific pattern, then this CAD is converted into a bitmap file that will be turned into a patterned flexo-master 110. The drawing of the pattern has to be made according to transverse orientation 304 (T) or machine orientation 302 (M). If the drawing from the CAD file is for a transverse orientation (T) pattern, continuous patterned lines 1304 are preferred as it allows an improved control over printing factors such as printing speed, ink 120 viscosity, pressure and volume of ink 120. If the drawing from the CAD file is for a machine orientation (M) pattern, a non-continuous patterned line 702 is preferred. It is appreciated that printing results may vary based on the ink viscosity, surface energy of the substrate (both natural and changes induced through Corona discharge), temperature of the components, as well as the size/volume of the anilox roll used. In one example, anilox rolls with a volume of less than 1 BCM (Billion Cubic Microns per square inch) may have a dot gain that is small enough to not significantly alter dimensions of printed features because as the volume of ink transferred from the anilox roll to the flexoplate decreases, there is less ink present to contribute to malformation or incomplete formation of features. However, if the dimensions of the printed pattern are small enough, even ink transfer from an anilox roll of 1 BCM or less may present a concern and an opportunity to use discontinuous lines. In most cases, however, the discontinuous lines on a flexo-master used to print continuous lines and features may be used for larger line widths.

Furthermore, the orientation printing angles may have certain characteristics that may limit the angles thereof. That is, orientation printing angles ranging between 0° to 45° and between 135° to 180° may be considered transverse angles 1302 as they are closer to transverse direction 304 (T) (0° and 180° degrees), thus continuous patterned lines 1304 are preferred. Conversely, orientation printing angles ranging between 45° to 135° degrees are considered machine angles 1306 as they are closer to machine direction 302 (M) (90° degrees), then non-continuous patterned lines 702 may be used. As such, while the transverse direction 304 is illustrated as being generally at or near perpendicular to the machine direction 302 in the figures above, and the term "transverse direction" 302 as used herein is used to define a direction that is not the same as the machine direction 304 but rather intersects the machine direction 304. It is appreciated that, while the machine direction 304 and the transverse direction 302 are illustrated in various figures above, the directions indicated in those figures are merely illustrative and that the determination of the range angles of lines in both directions may include considerations such as ink viscosity, machine pressure, and pattern design as well as other factors such as machine speed. In an embodiment, the printing plate cylinder rotates in a first direction, and a portion of the plurality of lines are oriented within a first predetermined range of the first direction. In this embodiment, a portion of the plurality of lines are oriented at an angle outside of the first predetermined range of the first direction, wherein the plurality of lines within the first predetermined range are discontinuous lines; and the plurality of lines outside of the first predetermined range are continuous lines.

Figure 14:
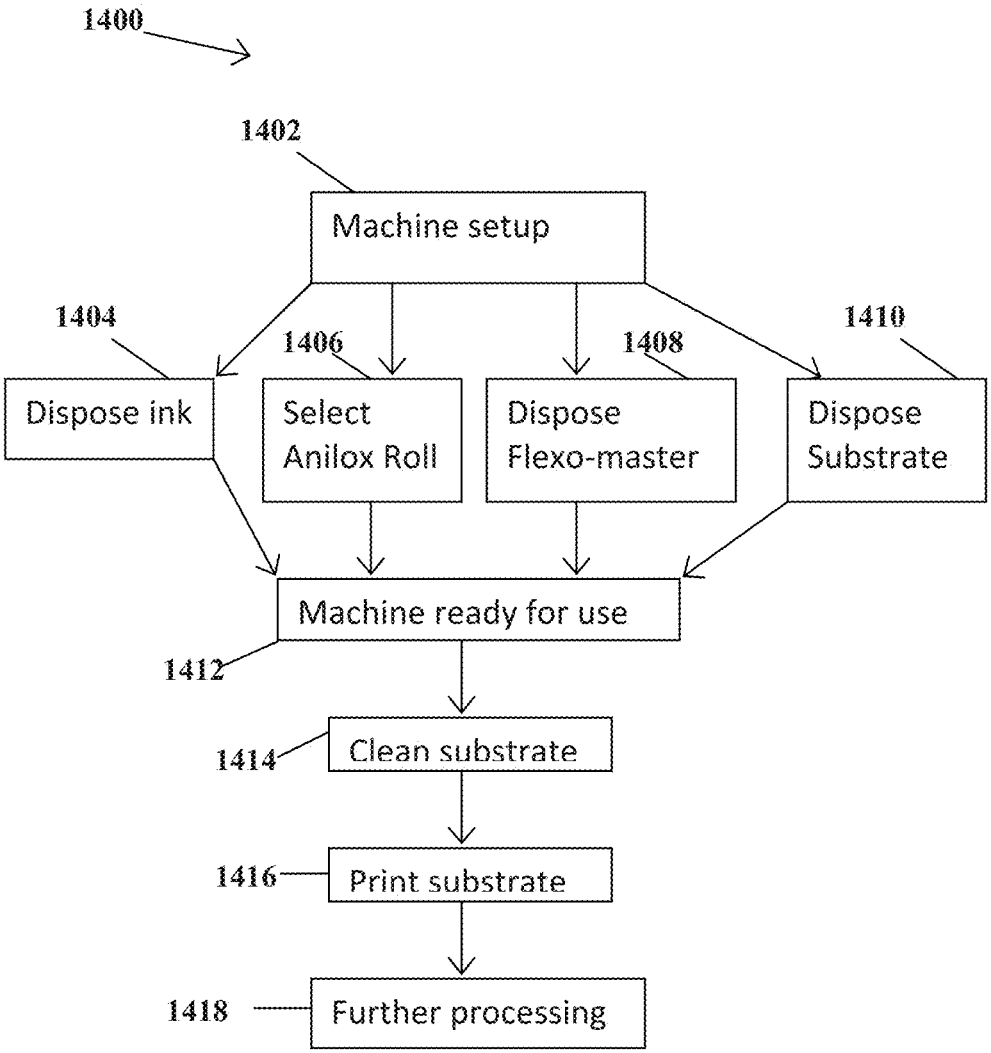
FIG. 14 is a flow chart of a method of flexographic printing according to embodiments of the present disclosure.

FIG. 14 is a flow chart of a method of flexographic printing according to embodiments of the present disclosure. In method 1400, the flexo-graphic printing system, for example, system 100 as discussed in FIG. 1, is set up at block 1402. The machine setup at block 1402 may comprise disposing ink at block 1401 into an ink pan 102 or other ink source, selecting at least one anilox roll 106 at block 1406, disposing a flexo-master 110 on to a printing plate cylinder 108 at block 1408, and disposing the substrate 116 in to the system 100. The substrate 116 may be a printable substance such as polyethylene terephthalate (PET), High-density polyethylene (HDPE), linear low-density polyethylene (LLDPE), biaxially-oriented polypropylene (BOPP), polyester, polypropylene, foam sheets, paper, aluminum foil, other metallic foil, or thin glass.

In some embodiments, more than one ink type may be used so there may be more than one ink source 102. In some embodiments, a plurality of anilox rolls 106 and printing plate cylinders 108 may be used in the method 1400. In those embodiments, the plurality of printing plate cylinders 108 may each have a flexo-master 110 disposed on it at block 1408, where each flexo-master 110 comprises a different portion of a single pattern. These different portions may comprise varying line widths, transitional geometries, and may use the same ink or different types of ink. At block 1412 the flexographic printing system 100 is ready for use, the substrate 116 disposed into the system 100 at block 1410 may be cleaned at block 1414 using a water wash, web cleaner, or other cleaning method. At block 1416, the substrate 116 is printed using the at least one flexo-master 110 disposed on the at least one printing plate cylinder 108 at block 1408. In some embodiments, the substrate 116 as discussed above may be printed one a single side and in some embodiments the substrate 116 may be printed on both sides. The double-sided printing may be accomplished by using a single flexo-master 110 disposed on a single printing plate cylinder 108, or by a plurality of flexo-masters 110 using a plurality of printing plate cylinders 108, and each side may be printed in the same manner or in a different manner, using the same ink or a plurality of inks as appropriate for the application. As discussed above, at least in part to leverage inherent properties of ink due to its viscosity, composition, temperature sensitivity, pressure sensitivity as well as other system factors, the at least one flexo-master 110 used to print the pattern may comprise at least one discontinuous line, a junction shape smaller than the printed junction shape, a single line that prints two lines, or at least two lines that are used to print a single line. At block 1418, the printed substrate from block 1416 may be further processed. It is appreciated that the further processing may include curing, plating, electroless plating, coating, trimming, cutting, packaging, and/or further assembly.

Figure 15:
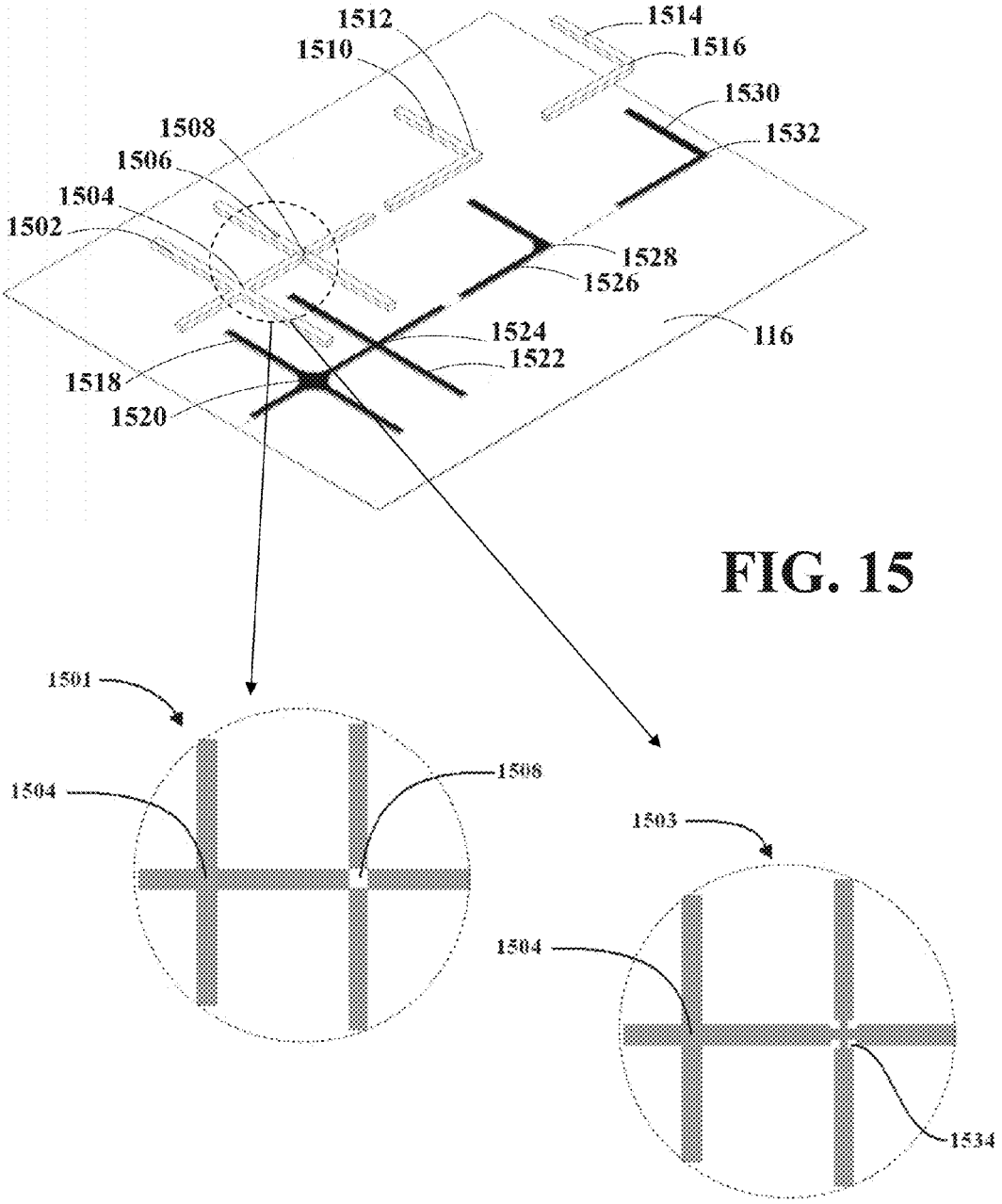
FIG. 15 is an illustration of a plurality of flexo-master pattern feature and resulting printed pattern features.

FIG. 15 is an illustration of a plurality of flexo-master pattern feature and resulting printed pattern features. FIG. 15 shows the printed results on the substrate 116 from four patterns on the flexo-master 110 (not shown). The patterns on the flexo-master 110 are depicted above the printed results on substrate 116. The printed patterns are: (1) a first flexo-master junction 1502 having a solid intersection 1504, (2) a second flexo-master junction 1506 having a hollowed-out intersection 1508 as compared to solid intersection 1504 (see exploded view 1501), (3) a first angle pattern 1510 with a solid corner 1512, and (4) a second angle pattern 1514 with a hollowed-out corner 1516 as compared to the solid corner 1512 which may also be referred to as a fillet. It is appreciated that the term "corner," as used herein, may be used to describe an of any degree formed by one or more lines.

It is appreciated that, while two intersecting lines and a corner are illustrated in FIG. 15, more than two lines may form a junction, depending upon the embodiment, and that the flexo-master pattern portions shown in FIG. 15 are for illustrative purposes to compare to the printed patterns and are not actually located on the substrate 116. A hollowed-out intersection 1508 on the flexo-master is best described as compared to a solid intersection 1504 in that the solid intersection 1504 may be where two or more lines intersect at any angle and the dimensions of each intersecting line are preserved in the dimensions of the solid intersection 1504. It is appreciated that the expanded view 1501 of features 1504 and 1508 is shaded for illustrative purposes to clarify, the hollowed-out intersection 1508 is where the dimensions of each intersecting line are not preserved and instead a portion of the line is carved out to create a hollow 1508 which may also be described as a hollow void. It is appreciated that the flexo-master may be manufactured with this feature, and that the term "carved-out" refers to the flexo-master feature as compared to the printed feature. It is also appreciated that a flexo-master may be manufactured as discussed above and then further processed to thermally and/or mechanically alter feature size in order to print a corresponding feature within certain dimensional ranges.

It is appreciated that the expanded view 1503 of intersection features 1504 and 1508 is shaded for illustrative purposes to clarify the hollow 1534, and that, while four hollows 1534 at the intersection of two lines are illustrated in FIG. 15, more than two lines may intersect, and the intersection may comprise one or more hollows 1534 depending upon factors such as ink viscosity, machine speed, pressure, and pattern dimensions. In some embodiments, if there is more than one hollow 1534, the hollows 1534 may be of uniform size, and in other embodiments the hollows may be of differing dimensions. An intersection of two or more lines may be referred to as a junction or as an intersection, or as a collection of fillets or hollows 1534.

Printing the first flexo-master junction 1502 having a solid intersection 1504 results in the printed first crossing line pattern 1518 having a large/over-filled printed intersection 1520 at the intersection of the crossing lines. The term "over-filled" is used to reflect that the printed feature did not print to the dimensions specified for a particular feature, features and/or overall pattern. Printing the second flexo-master junction 1506 with a hollowed-out intersection 1508 results in the printed second crossing line pattern 1522 having a small, as compared to the larger intersection 1520 discussed below, printed intersection 1524 at the intersection of the crossing lines. In an embodiment, the small printed intersection 1524 is printed to a plurality of predetermined dimensions that may be associated with a particular application. Therefore, while it may be referred to as a "small" printed intersection 1524, the dimensions printed are merely small as compared to the large printed intersection 1520 which was printed without the fillets 1534 of the hollowed-out intersection 1508. This difference can also be explained by observing that, in the preferred embodiment, the shape/geometry of the hollowed-out intersection 1508 at or near the point of intersection is different than the corresponding location on the smaller printed intersection 1524.

Printing the first flexo-master angle pattern 1510 having a solid corner 1512 results in the first printed angle pattern 1526 having a large/over-filled printed corner 1528 at the corner of the angled lines. Printing the second flexo-master angle pattern 1514 having a hollowed-out corner 1516 results in the second printed angle pattern 1530 having a small printed corner 1532 at the corner of the angled lines. Therefore, in an embodiment, if there is a desire to control the movement of the ink with respect to a printed junction or intersection of two or more lines, a hollowed-out intersection 1508 may be used on a flexo-master where the dimensions of the hollowed-out intersection 1508 are smaller than the dimensions of the desired printed intersection. The geometry of the hollowed-out intersection 1508 is thereby used to affect the printed pattern. In another embodiment, it is understood that this modified hollowed-out intersection 1508 does not print its geometry on the substrate 116 but rather is designed with properties such as ink viscosity, flexo-master material, pressures, and other factors to print a portion of a pattern within a predefined tolerance range of at least height, width, and length. It may be said that the junction/corner/intersection embodiment in FIG. 15 is one wherein the shape of a flexo-master feature is different than the shape of the corresponding printed feature to minimize the occurrence of large/over-filled corner 1528 and intersection 1520.

In an embodiment, a high precision flexo-master for making printed electronic patterns is comprised of raised printing surfaces where the ink is transferred from the flexo-master to the substrate, leaving a printed pattern on the substrate. The flexo-master preferably includes a non-continuous pattern to form straight lines that are printed in the machine direction as discussed in FIG. 7. In yet another embodiment, a high precision flexo-master for making printed electronic has patterned lines in a transverse direction where the lines are continuous patterns. The desired width of line is achieved by optimizing the printing factors such as target speed, viscosity, pressure and volume of ink. In a related embodiment, a single line may be use to print two lines as discussed in FIG. 4C, or multiple lines on the flexo-master may be used to print a single line, leveraging the otherwise undesirable phenomena in FIG. 6. It is appreciated that the systems and methods disclosed herein may utilize any combination of the flexo-master features described above in order to reliably print uniform patterns.

Certain terms are used throughout the following descriptions and claims to refer to particular system components. This document does not intend to distinguish between components that differ in name but not function. In the following discussion and in the claims, the terms "including" and "comprising" are used in an open-ended fashion, and thus should be interpreted to mean "including, but not limited to . . . ". As used herein, the word "approximately" is intended to mean "plus or minus 10%."

It is appreciated that the embodiments described herein with respect to the junctions, a single flexo-master line printing two lines, multiple flexo-lines printing one line, and discontinuous lines as well as flexo-masters of varying thickness may be used in various combinations to produce microscopic printed patterns. The methods and systems disclosed herein may use various combinations of these embodiments along with multiple types of ink in a single flexo-printing system, and in some cases multiple printing plate cylinders may be used to print a single pattern, where each printing plate cylinder has a portion of the pattern in a flexo-master disposed on the printing place cylinder.

We claim:

1. A system for flexographically printing a microscopic pattern using a plurality of flexo-masters comprising:

a plurality of printing plate cylinders and a plurality of flexo-masters, a substrate;

wherein at least some of the plurality of printing plate cylinders are used to print a single pattern using at least one ink type from at least one ink source;

wherein each flexo-master of the plurality of flexo-masters is disposed on each of the at least some of the plurality of printing plate cylinders and comprises at least a portion of the single pattern, wherein each portion of the single pattern comprises a plurality of lines;

wherein at least one flexo-master of the plurality of flexo-masters comprises a pattern formed by a plurality of lines including at least one junction; and wherein at least one of the lines of the plurality of lines is a discontinuous line; and wherein the at least one flexo-master prints the pattern on the substrate using the ink, wherein the printed junction has a different shape than the at least one junction on the flexo-master, and wherein the at least one discontinuous line prints a continuous line on the substrate.

2. The system of claim 1, wherein each flexo-master deposits the at least one ink type in a plurality of predetermined locations associated with the single pattern.

3. The system of claim 1, wherein each flexo-master does not deposit the at least one ink type in areas other than a plurality of predetermined locations associated with the single pattern.

4. The system of claim 1, wherein a single line of the plurality of lines simultaneously prints two separate, parallel lines on the substrate.

5. The system of claim 1, wherein a first line of the plurality of lines is parallel to a second line of the plurality of lines, wherein the first and second line are used to form a single line on the substrate.

6. The system of claim 2, wherein the junction on the flexo- master includes one or more hollow voids, and wherein the printed junction does not include hollow voids.

* * * * *